US005758671A

United States Patent [19]

Thim

[11] Patent Number: 5,758,671

[45] Date of Patent: Jun. 2, 1998

[54] WEARING ACCESSORY AND METHOD OF MAKING

[76] Inventor: Thoeum Thim, 13441 Cypress, Garden Grove, Calif. 92643

[21] Appl. No.: 729,563

[22] Filed: Oct. 11, 1996

[51] Int. Cl.[6] ..... A45D 8/36

[52] U.S. Cl. ..... 132/273; 2/170

[58] Field of Search ..... 132/273, 275; 2/174, 170, 311, 313

[56] References Cited

U.S. PATENT DOCUMENTS

| | | | |
|---|---|---|---|
| D. 131,600 | 3/1942 | Holden . | |
| D. 158,103 | 4/1950 | Kuenstner | D86/10 |
| D. 167,553 | 8/1952 | Behr | D86/10 |
| D. 221,115 | 7/1971 | Solomon | D86/10 |
| D. 292,030 | 9/1987 | Revson | D28/41 |
| D. 315,036 | 2/1991 | Leopold | D28/41 |
| D. 315,226 | 3/1991 | Revson | D28/41 |
| 537,542 | 4/1895 | Moore . | |
| 971,519 | 10/1910 | Brannen . | |
| 1,636,107 | 7/1927 | Namiot | 2/311 |
| 2,668,547 | 2/1954 | Wille . | |
| 2,805,673 | 9/1957 | Solomon . | |
| 2,945,500 | 7/1960 | Bolinger . | |
| 3,099,271 | 7/1963 | Dubelier . | |
| 3,301,266 | 1/1967 | Hoffman . | |
| 5,044,385 | 9/1991 | Rhodes | 132/275 |
| 5,067,177 | 11/1991 | Binder | 2/170 |
| 5,133,295 | 7/1992 | Lippincott | 132/273 |
| 5,144,696 | 9/1992 | Kahl | 2/311 |
| 5,156,171 | 10/1992 | Goodman | 132/275 |
| 5,239,705 | 8/1993 | Leopold | 132/273 |
| 5,301,696 | 4/1994 | Revson | 132/275 |
| 5,372,151 | 12/1994 | Kuo | 132/273 |
| 5,413,126 | 5/1995 | Revson | 132/275 |

FOREIGN PATENT DOCUMENTS 768522 8/1934 France .

*Primary Examiner*—Todd E. Manahan
*Attorney, Agent, or Firm*—Leo F. Costello

[57] ABSTRACT

A wearing accessory for use as a hair fastener, armband or legband and a method of making the same. The accessory includes an annular, flexible sleeve of cloth in which is provided a central annular pocket between outer portions. An annular flat elastic band is captured in the pocket with its wide dimension generally perpendicular to the radius of the band and sleeve but is allowed to move in the pocket. The accessory has an unstressed contracted condition wherein the sleeve is gathered circumferentially in closely bunched wrinkles along the pocket and is gathered in more widely spaced undulations or ruffles in the outer portions, and these undulations wind in a serpentine manner circumferentially of the accessory, partially or completely spiraling therearound, thereby creating a distinctive appearance. The accessory also has a stressed expanded conditions wherein the wrinkles and undulations remain, albeit each more widely spaced than in the unstressed condition.

13 Claims, 5 Drawing Sheets

WEARING ACCESSORY AND METHOD OF MAKING

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND

Various devices have been developed to fasten one's hair in a ponytail, braid, or a bunch. These devices typically include a fastening element to hold the hair and a decorative element that is supported by the fastening element. The fastening element may be a ring of metal or other hard material, but it is more commonly some form of an elastic band. Although hair fasteners can be just fasteners with no decorative feature, the addition of ornamentation greatly enhances the appeal of the device. Such devices are also used as wrist or armbands or ankle or leg bands.

A very popular type of hair fastener or wearing accessory, is an endless, annular sleeve or tube of cloth and a rubber band in the sleeve that contracts the sleeve around the hair or body part and creates folds and pleats around the annulus to provide ornamentation. Such a fastener is shown in the U.S. Pat. No. Des. 292,030. The sleeve is expanded to receive a bunch of hair or an ankle or wrist and when released contracts to secure the hair, ankle, or wrist while displaying the folds and pleats. In an effort to create different appearances, other such hair fasteners of this type have been developed as disclosed in U.S. Pat. Nos. Des. 315,036 and 3 15,226.

Although the patented devices are functional and decorative, their construction does not produce the most intricate folds, pleats, configurations, and shapes, or other visual effects they also do not house the rubber band in the most optimum manner for its ideal positioning against the body, especially when the device is worn on the wrist or ankle wherein flat engagement of a band of rubber may be preferred.

SUMMARY

A wearing accessory for use as a hair fastener, armband or legband and a method of making the same are disclosed. The accessory includes an annular, flexible sleeve of cloth in which is provided a central annular pocket between outer wing portions. An annular flat elastic band is captured in the pocket with its wide dimension generally perpendicular to the radius of the annulus formed by the sleeve but is allowed to move in the pocket. The accessory has an unstressed contracted condition wherein the sleeve is gathered circumferentially in closely bunched wrinkles along the central pocket and is gathered in more widely spaced undulations or ruffles in the wing portions. These dual undulations or double ruffles wind in a serpentine manner partially or completely circumferentially of the accessory, thereby creating a distinctive appearance. The accessory also has stressed expanded conditions wherein the wrinkles and undulations remain, albeit each more widely spaced than in the unstressed condition.

An object of this invention is to provide improvements in a wearing accessory for use as a hair fastener, a wrist-armband, or an ankle- or legband.

An additional object is to assemble an annular elastic band in an annular sleeve of cloth so that the cloth is gathered into undulations that create a spiraling effect about the sleeve.

A further object is to position an elastic in an annular sleeve of a wearing accessory so as to create decorative folds that wind about the accessory in a serpentine manner.

Another object is position an elastic band in an accessory for fastening the hair or for adorning the arm or wrist so that it exerts its elastic constriction in a more efficient and comfortable manner.

Still another object is to provide a method of assembling an elastic band in an annular cloth sleeve of a wearing accessory of the type described so that the band is captured in the center of the sleeve for body-fastening purposes and creates undulations in side portions of the accessory that appear to spiral circumferentially of the sleeve.

These and other objects and advantages of the invention will become apparent upon reference to the accompanying drawings and the following detailed description.

DETAILED DESCRIPTION

Figure 1:
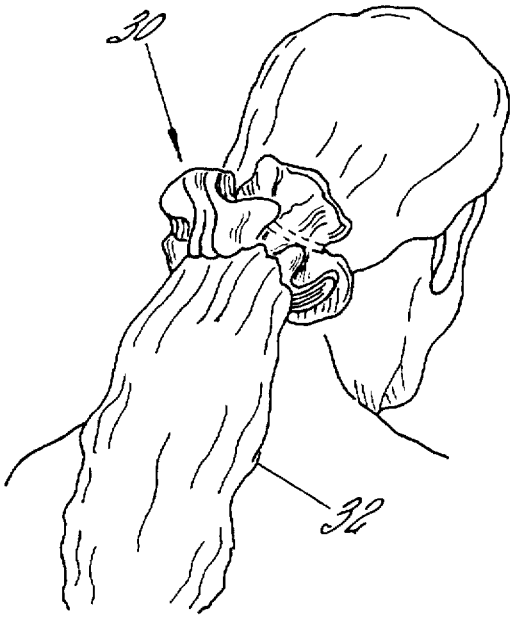
FIG. 1 is a perspective view of the wearing accessory of the present invention being worn as a hair fastener.
Figure 2:
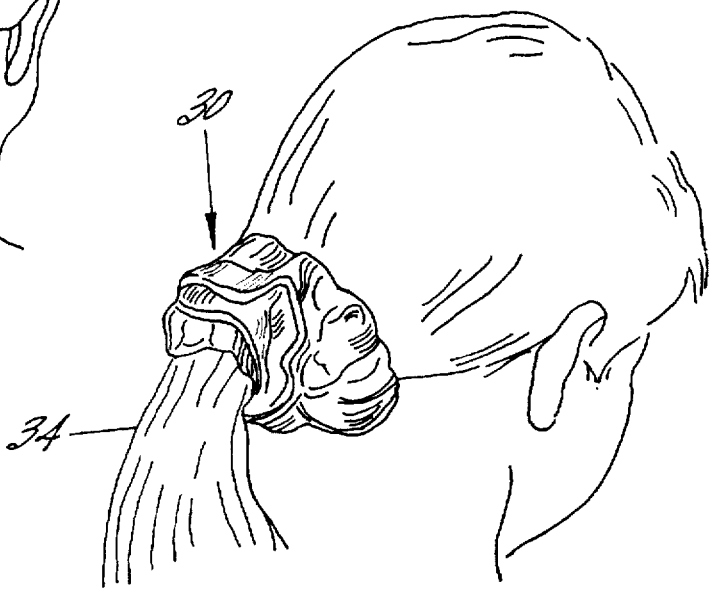
FIG. 2 is a view similar to FIG. 1 but showing the accessory doubled over for fastening the hair in a smaller bunch such as a ponytail.
Figure 3:
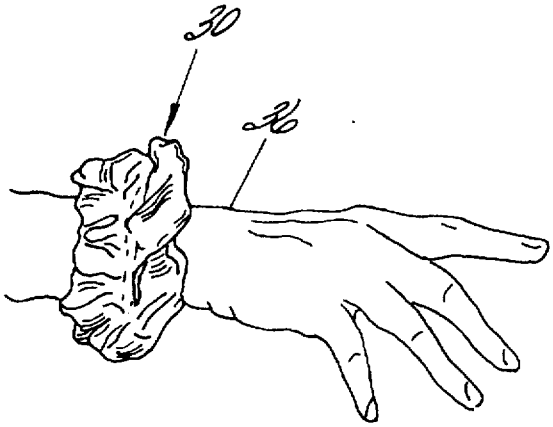
FIG. 3 is a perspective view showing the accessory being worn on the wrist or arm.
Figure 4:
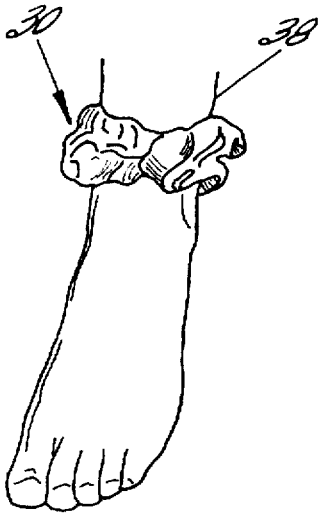
FIG. 4 is a perspective view showing the accessory being worn on the ankle or leg.
Figure 5:
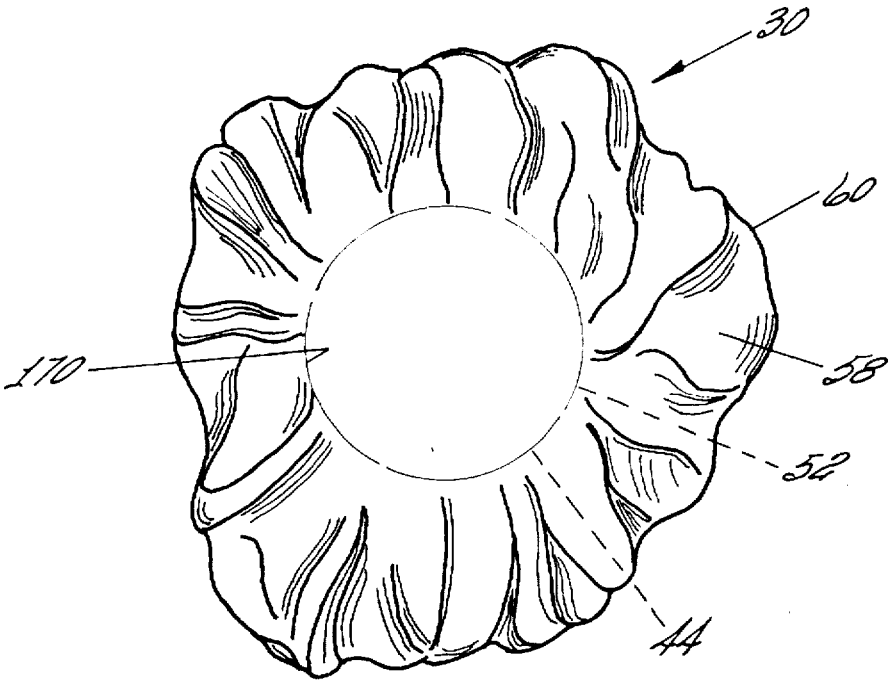
FIG. 5 is an enlarged end or plan view of the subject accessory around a tubular mandrel, not part of the present invention but used in the Figure to simulate a bunch of hair, an arm or a leg, thereby to open up the accessory and provide a different view of the undulations.

A wearing accessory in accordance with the present invention is shown in FIGS. 1–7 and identified by the numeral 30. As illustrated in FIGS. 1–4, the accessory may be worn as a hair fastener (FIGS. 1 and 2), as a wrist- or armband (FIG. 3), or as an ankle- or legband (FIG. 4). The accessory may be fastened about a larger bunch 32 of hair, as in FIG. 1, or twisted into a figure eight and doubled over to hold a smaller bunch of hair such as ponytail 34, as in FIG. 2. Further, the accessory may be encircled about the wrist or arm 36 or ankle or leg 38, usually without the need for doubling, as shown in FIGS. 3 and 4.

Figure 18:
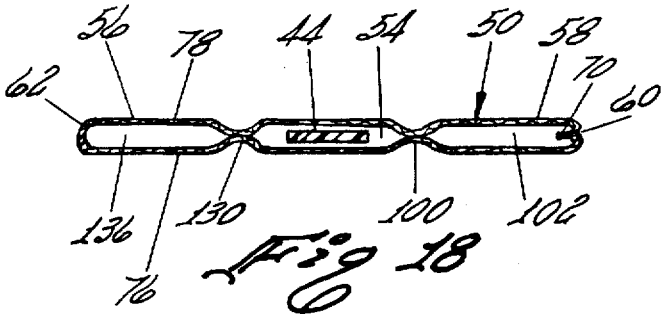
FIG. 18 is an enlarged transverse section taken on line 18—18 in FIG. 17.

In general, and with reference to FIGS. 6, 7, 17 and 19 in particular, the accessory 30 includes an endless, annular sleeve or tube 50 of cloth and an elastic band 44. The sleeve has an annular center portion 52, in which is provided an annular center pocket 54 (FIG. 18), and a pair of annular outer or wing portions 56 and 58 (FIG. 7) that extend in various directions from the center portion and terminate in outer edges 60 and 62. The elastic band is positioned in the center pocket and is of a length such that it contracts or constricts the sleeve in a manner and for purposes to be described.

To better understand the construction and features of the subject accessory 30, the method of the present invention is described initially. With reference to FIGS. 8–18, the sleeve 50 is shown prior to its assembly with the elastic band 44. The sleeve may be made of various cloth materials such as but not limited to jersey, lycra, cotton knit, interlock, and thermal materials, and of natural or synthetic fibers. The sleeve is formed from a rectangular piece of cloth that is folded and sewn into the sleeve. The sleeve is then formed in an annulus in a well known manner and, as a result, has a longitudinal seam 70 along one outer edge 60, a transverse seam 72 joining opposite ends 73 and 74 of the sleeve (prior to its formation in the annulus), and inside and outside walls 76 and 78. The longitudinal seam provides a gap 80 leading into the hollow interior of the sleeve and for a purpose to be described.

Although the subject invention is not limited to particular dimensions, it is believed useful to provide an example of a range of dimensions for preferred embodiments so that as the description proceeds, it will be understood from these particular embodiments how the objectives of the invention are accomplished. Accordingly, the circumference of the sleeve, from end 73 to end 74, is preferably from about twenty to about twenty-four inches, and the width of the sleeve, from edge 60 to edge 62, is preferably from about two to about two and one-half to three inches.

The elastic band 44 (FIGS. 10 and 18) is formed from a flat strip 90, preferably of cotton elastic, having opposite ends 92 and 93. The dimensions of the strip found to be useful for the preferred embodiment are a length of from about eight to about eight and one-half inch long, end-to-end, a width of from about 3/16" to about ¼"; and a thickness of less than about 1/16". It is thus understood that the elastic strip is much shorter than the circumference of the sleeve 50, that is, from about one-third to less than about one-half such circumference.

Figure 11:
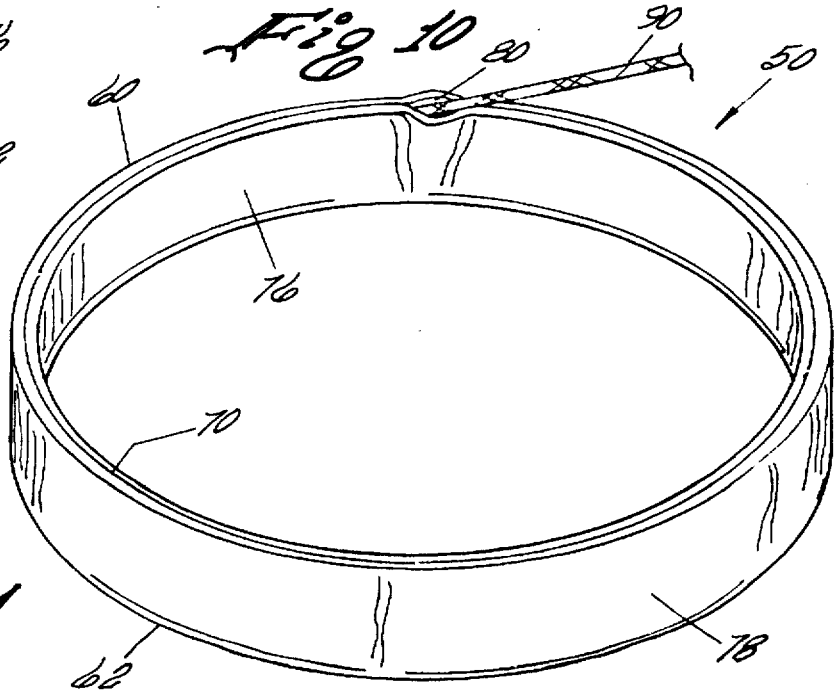
FIG. 11 is an isometric view showing insertion of the elastic strip of FIG. 10 in the sleeve of FIG. 8.
Figure 12:
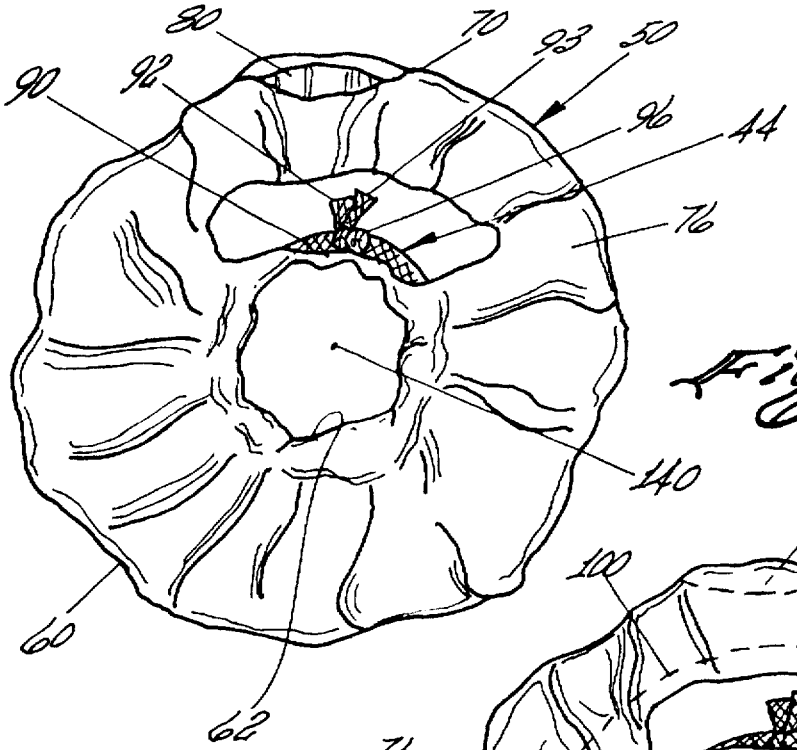
FIG. 12 is a plan view of the sleeve with a part thereof broken away to show the elastic fully inserted in the sleeve and tied in a band.

The assembly of the elastic strip 90 with the sleeve 50 is shown in FIGS. 11 and 12 but is preliminary to performing the steps of the present invention. One end 73 of the strip is inserted in the gap 80, and the strip is threaded through the hollow interior of the sleeve until the end 73 goes all the way around the sleeve and both ends 73 and 74 can be grasped through the gap and tied together in a knot 96, as seen in the broken away part of the sleeve in FIG. 12, to form the band 44. At this time the elastic band constricts or contracts the non-seamed edge 62 of the sleeve whereas the seamed edge 60 is hardly constricted, if at all. Thereafter, the gap is sewed to close access to the interior of the sleeve.

Figure 13:
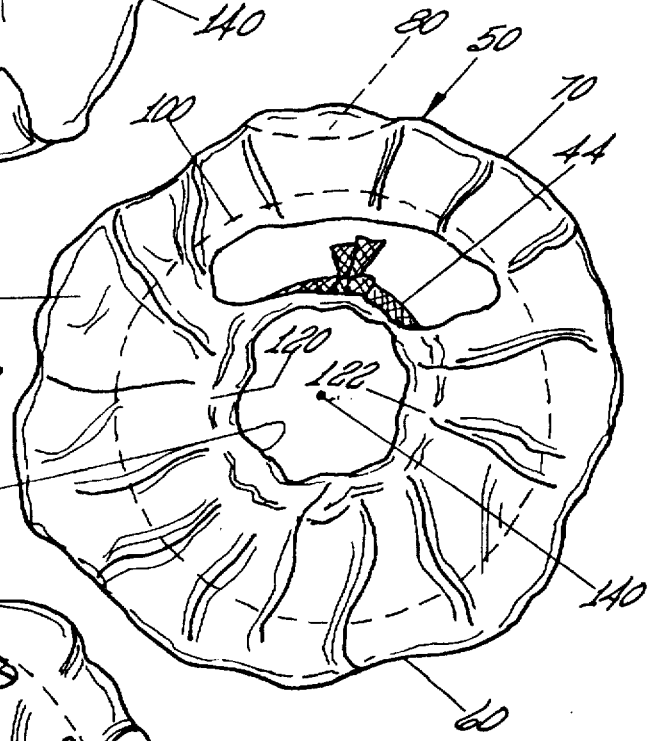
FIG. 13 is a view similar to FIG. 12 especially to show a first line of stitching sewed in the sleeve in the first step of the method of the present invention.

In accordance with the present invention, the first step of the subject method is to sew a first circular line or row of stitches 100 in the sleeve 50 in generally concentric, circumscribing relation to the sleeve, as shown in FIG. 13. The first line of stitches is in inwardly adjacent spaced relation to the seamed edge 60 of the sleeve, preferably about ½" to about ¾" from the seamed edge in the embodiments having the dimensions described above. This first line of stitches sews the inside and outside walls 76 and 78 of the sleeve together to form an outside pocket 102 (FIG. 18) between the seamed edge, the first line of stitches and the walls.

Figure 14:
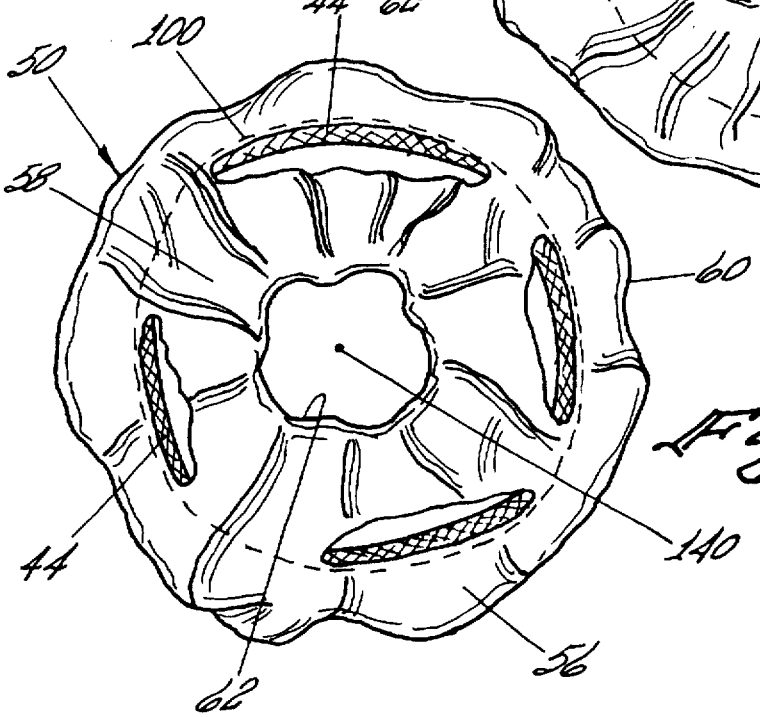
FIG. 14 is a view similar to FIG. 13 and showing the elastic band moved out against the first line of stitching in a further step of the present method.
Figure 15:
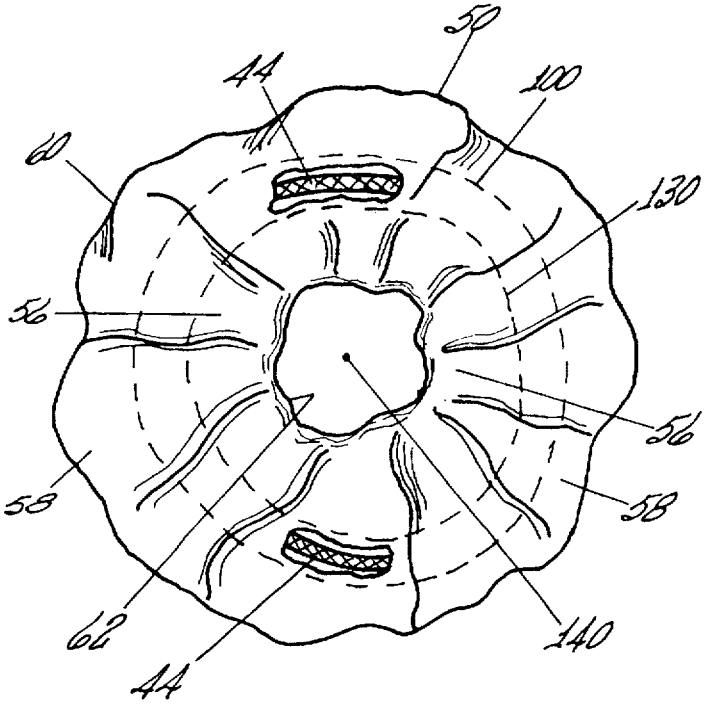
FIG. 15 is a view similar to FIG. 14 especially to show a second line of stitching sewed in the sleeve in an additional step of the subject method.
Figure 16:
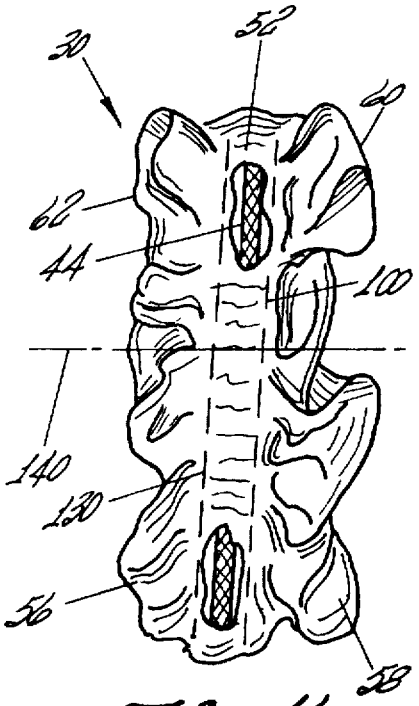
FIG. 16 is an edge view of the subject accessory similar to FIG. 7, but broken away to show the elastic band in the sleeve.
Figure 17:
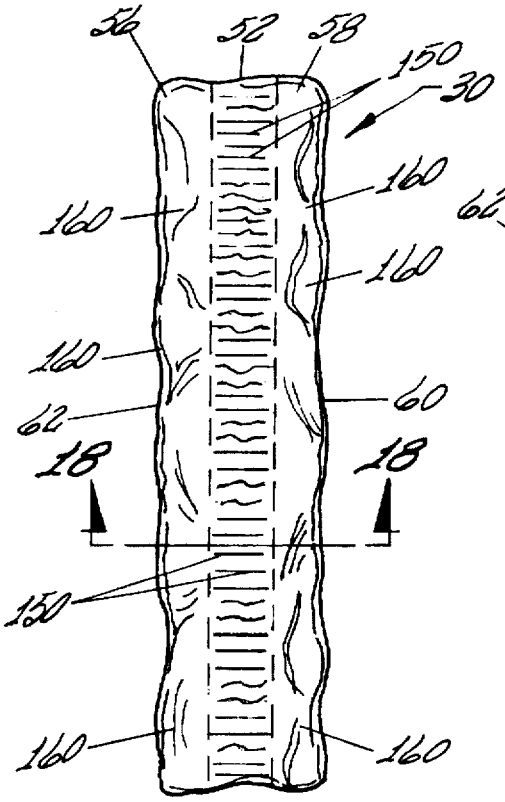
FIG. 17 is an edge view like FIG. 7 or FIG. 16 but showing the sleeve and elastic band stretched out in a stressed, expanded condition in order better to show the center wrinkles and the side undulations created by the positioning of the elastic band in the central pocket of the sleeve.

The next step is to move the elastic band 44 (FIG. 13) from its initial position against the non-seamed edge 62 outwardly against the first line of stitching 100. To accomplish this second step, the non-seamed edge 62 of the sleeve 50 is grasped between the thumb and forefingers of the assembler's hands at two, diametrically opposite spots, such as at 120 and 122. The spots grasped are then pulled outwardly away from each other, thereby causing the elastic band to slide transversely of the sleeve toward and into engagement with the first line of stitching (FIG. 14). Additional diametrically opposed spots around the non-seamed edge are grasped and pulled outwardly until the entire band is against the first line of stitches. Such grasping and pulling causes the sleeve to take on a different non-flattened shape not shown in the drawings but between the relatively flat shape of FIG. 13 and the final shape of FIG. 16. FIGS. 14 and 15 still show relatively flat representations of the sleeve since they help to illustrate what is happening within the sleeve, but after the described pulling and outward movement of the band, the sleeve no longer remains in a relatively flat condition by itself and begins to fold toward its final position unless it is held in a flattened state. That is, in FIGS. 14 and 15, if not held there, the non-seamed edge 62 tends to move out of the plane of the paper toward the viewer and toward a position where the wing 56 is in opposed relation to the wing 58 as seen in FIG. 16.

The third step (FIG. 15) is to sew a second line of stitches 130 in inwardly spaced relation to the first line of stitches 100 and on the opposite side of the elastic band 44. In the preferred embodiments being described, the second line of stitches is spaced from about ½" to about ¾" from the non-seamed edge 62. The second row of stitches forms the central pocket 54 (FIG. 18) between the two lines of stitching 100 and 130 and the inside and outside walls 76 and 78. Moreover, another outer pocket 136 is thereby formed between the second line of stitching, the walls and the non-seamed edge. In the preferred embodiment therefore, the two outer pockets 102 and 136 are located in the outer portions or wings 58 and 56, respectively, and are of about equal width and preferably wider than the central pocket, although shown to be of equal width with the central pocket in FIG. 18. In addition, the width of the central pocket in the preferred embodiments varies from about ½" to about ⅝" and is thus greater than the width of the elastic band. The radial dimension of the central pocket is such as to constrain the elastic from twisting in the pocket so that the width dimension of the elastic band remains generally perpendicular to radii radiating from an imaginary axis at 140 (FIG. 16). It is to be noted that the elastic band is preferably not sewed to the sleeve and although it is constrained from twisting in the pocket, it nevertheless remains mostly free in the preferred embodiments to slide relative to the sleeve longitudinally and transversely within the pocket.

The most significant effect of capturing the elastic band 44 in the central pocket 54 between the first and second lines of stitching 100 and 130 is that it forms, and more descriptively contorts, the accessory 30 into its final shape, as shown in FIGS. 1–7, 16 and 17. The elastic band in the pocket causes the center portion 52 of the sleeve to gather in closely spaced wrinkles 150 circumferentially of the sleeve with adjacent peaks of the wrinkles being spaced from about 1/16" to about ⅛" in the described embodiments. The band and its enclosure in the center pocket causes the wings 56 and 58 to form much more widely spaced undulations or ruffles 160 with adjacent peaks being spaced from about ½" to about 1" circumferentially of the sleeve. Whereas the center wrinkles tend to be more uniform in size, spacing and shape (although not exactly so), the undulations are very irregular in size, shape and spacing, with such irregularity varying in different embodiments especially as a function of the type of cloth material used. That is the heavier materials create more irregularity as will be described below.

A very interesting and appealing configuration (FIGS. 6, 7, 16, and 17) is created by the described assembly of the band 44 and the sleeve in that the outer edges 60 and 62 wind about the axis 140 in a serpentine or spiraling manner, an effect that is accentuated more in some fabrics, as thermal material, than in other fabrics. As is apparent from FIGS. 8 and 11, the sleeve 50 is not twisted into a spiral before the ends 73 and 74 are joined. Still, the outward appearance of the accessory gives the impression that the sleeve is twisted into a spiral.

Figure 6:
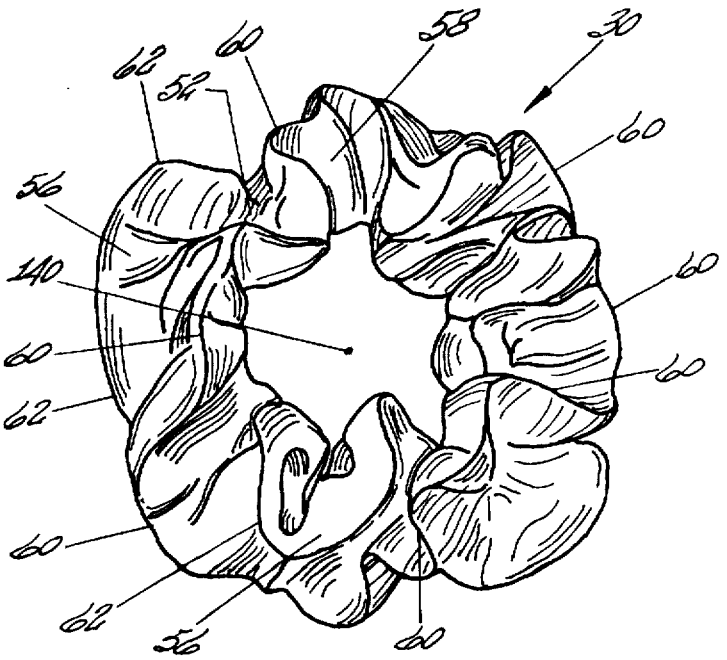
FIG. 6 is an end or plan view similar to FIG. 5 but showing the accessory removed the mandrel and in a relaxed, unstressed condition, as it appears from one vantage point when not being worn, and made with a heavier cloth material such as thermal so as to show the serpentine ruffles created by the subject invention.
Figure 7:
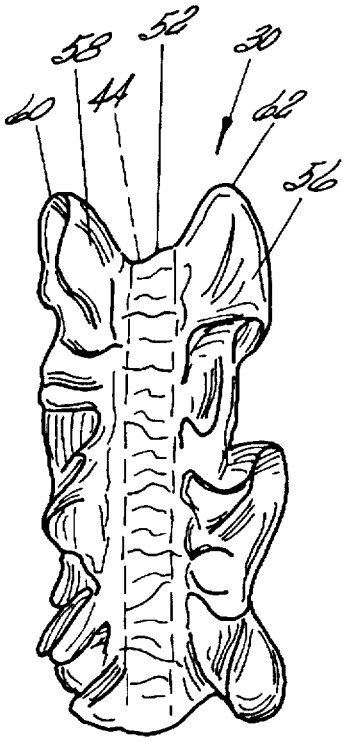
FIG. 7 is an edge view of the accessory as shown in FIG. 6 but with the wing portion of the accessory pulled apart as to disturb the natural winding effect of the wing portion and thereby to allow the center portion to be viewed more clearly than if the accessory were to assume its natural shape or its shape when worn, as in FIG. 3.
Figure 8:
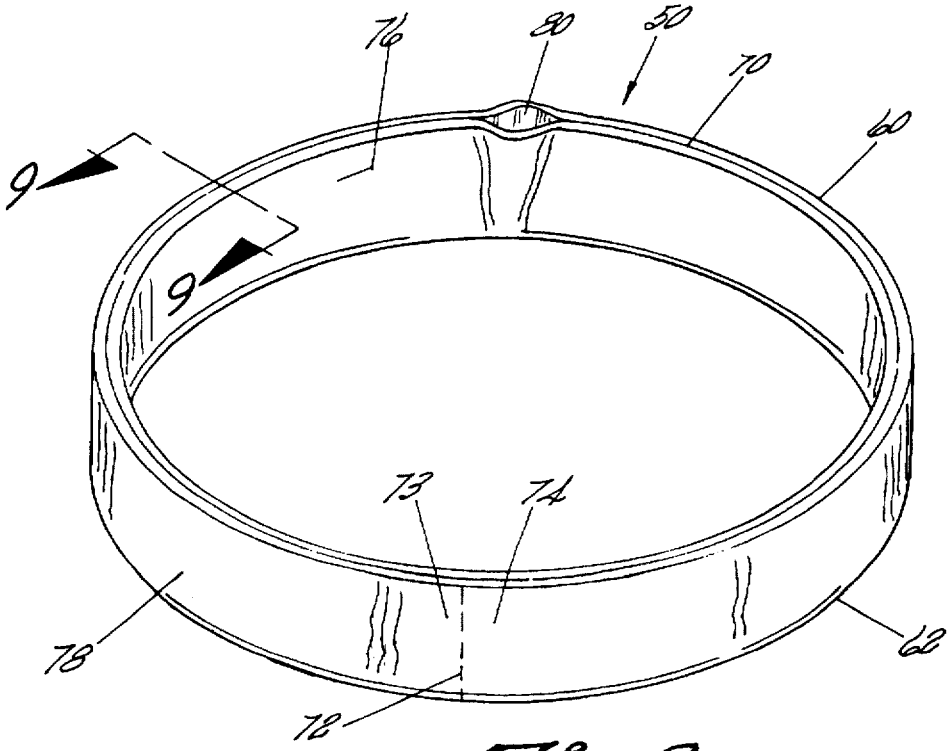
FIG. 8 is an isometric view of an annular sleeve used in the accessory of the present invention to show how the sleeve is prepared prior to its assembly with an elastic strip in carrying out the subject method.
Figure 9:
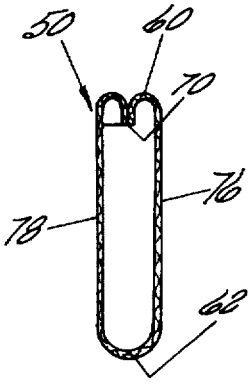
FIG. 9 is a section taken on line 9–9 of FIG. 8.
Figure 10:
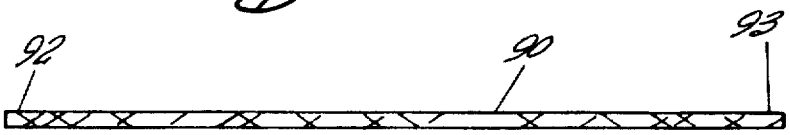
Fig. 10 is a plan of the elastic strip used in the accessory of the present invention to show how the elastic strip looks prior to carrying out the subject method.

In fact, although the sleeve 50 is not initially twisted, the edges 60 and 62 do trace a spiral pattern, either partially or completely around the accessory, as best illustrated in FIG. 6 wherein, by following the edges 60 and 62, this spiraling or serpentine path can be understood. Note, for example, that edge 62 of wing 56 at the left side of FIG. 6 traces a path that extends under the wing potion 58 toward the axis 140 into the annular opening of the accessory and then extends away from the axis and out of such annular opening over the wing portion 58, this is caused by the action of the elastic band 44 in the pocket 54. Depending on the cloth material used, this spiraling of the edges may extend around the full circumference of the accessory or partially therearound.

Each of the wing portions 56 and 58 (FIGS. 6 and 7) is undulated or ruffled with its edge 62 and 60 tracing the spiraling pattern as described, so that the accessory may be said to have, and does have, dual undulations or double ruffles. FIGS. 1–7, 16 and 17 provide several views of the external appearance described above, it being noted that in FIG. 5, the accessory 30 is placed on a mandrel 170 to provide a different view of the accessory 30 but as a result causing the spiraling or serpentine effect to be minimized or disappear.

From the foregoing it will be understood that certain improvements have been provided in a wearing accessory 30 for use as a hair fastener and/or as a wrist- armband or as an ankle- or legband. The annular sleeve 50 of cloth is assembled with the annular elastic band 44 so that the cloth is gathered into dual or double undulations or ruffles 160 that cause the sleeve to be in a complete or partial spiral. The elastic band is captured in the accessory so that it dependably fastens a bunch of hair in a ponytail or otherwise and so that it exerts its elastic constriction in a more efficient and comfortable manner especially when the accessory is used to adorn the wearer's arm or leg.

It is to be understood that the accessory 30 may be made by methods other than the method of the present invention, for example, the two lines of stitching 100 and 130 may be initially sewn in the sleeve 50 followed by insertion of the elastic strip 90 which is then tied to form the band 44. Thus the invention of the accessory article is not limited to the specific method of forming it whether as shown in FIGS. 8 through 15 and described above or otherwise.

Moreover, it is again emphasized that the neither the accessory 30 nor the method is limited to the particular dimensions as described above and maybe of larger or smaller sizes while still incorporating the basic principles of the invention.

Although a preferred embodiment of the present invention has been shown and described various modifications and substitutions may be made thereto without departing from the spirit and scope of the invention. Accordingly, it is to be understood that the present invention has been described by way of illustration and not limitation.

What is claimed is:

1. A hair fastener comprising:

an annular, flexible sleeve of cloth having a circumference of predetermined length, opposed inside and outside walls, and opposite side edges;

means forming an annular pocket in the sleeve intermediate said side edges; and annular elastic means positioned in the pocket so that it has an unstressed contracted condition wherein the sleeve is gathered with its walls undulated circumferentially of the sleeve and a stressed expanded condition wherein the sleeve is extended with its walls substantially smooth circumferentially of the sleeve, wherein the pocket forming means divides the walls into a pair of wall portions on opposite sides of the pocket, wherein said elastic means causes the wall portions to be irregularly undulated circumferentially of the sleeve whereby there are dual circumferential undulations, wherein the wall portions are of substantially equal width transversely of the sleeve and about equal to or larger than the pocket; and wherein the elastic means is a band of elastic having a width approximately one-half the width of the pocket.

2. A wearing accessory, comprising an endless, flexible sleeve of cloth providing an interior annular pocket formed by a pair of opposed side walls joined at opposite edges of the sleeve;

spaced lines of stitches joining and circumscribing the side walls of the sleeve in substantially parallel relation to each other and to said opposite edges, said stitches dividing the side walls into a pair of outside portions and an intermediate annular pocket between said side wall portions, said pocket being generally concentric with the sleeve and having a predetermined circumference; and an annular elastic band extended lengthwise in the pocket and being free to slide relative to the sleeve and within the pocket throughout a substantial portion of the length of the band, said band being expandable from an unstressed contracted condition to a stressed expanded condition, the band having a length in its contracted condition that is less than the circumference of the pocket thereby gathering the sleeve along the pocket and forming ruffles in the side walls extending circumferentially of the accessory.

3. The accessory of claim 2, wherein the circumference of the annular pocket when the sleeve is in fully extended position is from about two times to about three times longer than the circumference of the band in its fully contracted condition.

4. A wearing accessory that is useable as a hair fastener, an armband or a leg band, comprising:

an elongated, endless, flexible non-elastic sleeve of cloth formed into a circular shape from a rectangular piece of cloth that has opposite outer edges and opposite end edges and that is folded in half lengthwise with the outer edges joined to form a lengthwise seam in the sleeve and the end edges joined to form a transverse seam in the sleeve, said sleeve having a predetermined circumferential length approximately equal to the length of the rectangular piece of cloth and a predetermined width that is approximately one-half the width of the rectangular piece of cloth;

stitching threaded through the sleeve circumferentially thereof dividing the sleeve into an annular center pocket between a pair of annular outside pockets, said outside pockets having outside edges with the lengthwise seam constituting the outside edge of one of the pockets; and an elongated band of elastic having a circumferential length when fully stretched approximately equal to or slightly less than the circumferential length of the sleeve, said elastic band being loosely received in the center pocket in concentric relation to the sleeve whereby with the band fully contracted, the sleeve is gathered by the elastic to form closely bunched wrinkles lengthwise of the center pocket and to form more widely spaced undulations in the outside pockets that are of irregular shapes with adjacent peaks of the undulations being spaced farther from each other than adjacent wrinkles in the center pocket, with said undulations extending outwardly from the center pocket in a plurality of directions both toward and away from the axis of the sleeve and axially thereof, and with the outside edges of the outside pockets winding in a spiral pattern circumferentially of the sleeve.

5. A method of making an accessory for use as a hairpiece, an armband or a legband, said accessory being made from an endless, flexible sleeve of cloth having a pair of opposed side walls and opposite first and second edges joining the side walls, the sleeve providing an interior annulus, said annulus having a predetermined circumferential length, and an annular band of elastic extending through the annulus in engagement with said first edge, the band being shorter than said length thereby gathering the sleeve into a contracted condition, said method comprising:

fastening the side walls together along a first fastening line in inwardly spaced substantially parallel relation to said second edge of the sleeve;

sliding the band transversely of the sleeve and into engagement with the side walls adjacent to said first fastening line; and fastening the side walls together along a second fastening line in inwardly spaced substantially parallel relation to said first edge to capture the band between said fastening lines.

6. The method of claim 5, wherein the fastening step includes stitching the sleeve to form the first and second lines.

7. The method of claim 5, wherein the sliding step includes pulling outwardly from the center of the sleeve on diametrically opposite places on said first edge thereby causing the band to slide into engagement with said first line.

8. The method of claim 5, wherein the fastening steps includes stitching the sleeve to form first and second lines of stitching; and wherein the sliding step includes pulling outwardly from the center of the sleeve on diametrically opposite places on said first edge prior to forming the second line of stitching thereby causing the band to slide into engagement with said first line of stitching.

9. A method of making a hairpiece from an endless, flexible sleeve of cloth having a pair of opposed side walls and opposite edges joining the side walls, the sleeve providing an interior annulus, said annulus having a predetermined circumferential length, and an annular band of elastic extending through the annulus in engagement with one of the edges, the band being shorter than said length thereby gathering the sleeve into a contracted condition, comprising:

sewing a line of stitches through the side walls in inwardly spaced substantially parallel relation to the other of the edges of the sleeve;

pulling on diametrically opposite portions of said edge in order to slide the band transversely of the sleeve and onto engagement with the second edge; and sewing a line of stitches through the side walls in inwardly spaced substantially parallel relation to the other of the edges of the sleeve to capture the band between the lines of stitches.

10. A wearing accessory comprising:

a flexible sleeve of cloth or like material having a circumferential length and providing an annular pocket that circumscribes an axis of the sleeve, the pocket having opposite sides, an axial dimension that extends between the sides and is generally parallel to said axis, and a radial dimension that is generally perpendicular to said axis, flexible wing portions of cloth or like material extending outwardly from the opposite sides of the pocket and respectively terminating in side edges spaced from each other, and annular elastic means positioned in and extended lengthwise of the pocket and being slideable in and relative to the pocket, the elastic means having an unstressed contracted condition wherein it causes the sleeve to be gathered in relatively closely spaced undulations along the pocket and in relatively widely spaced undulations along each of the wing portions and a stressed expanded condition wherein the sleeve can be stretched out and the wing portions can be extended in opposite directions from the opposite sides of the pocket and in general alignment with the axial dimension of the pocket.

11. The wearing accessory of claim 10, wherein the elastic means causes at least a segment of the wing portions to trace a serpentine path relative to said axis.

12. The wearing accessory of claim 10, wherein the elastic means is a flat band.

13. A wearing accessory that is useable as a hair fastener, an armband or a leg band, comprising:

an elongated, endless, flexible non-elastic sleeve of cloth formed into a circular shape from a rectangular piece of cloth that has opposite outer edges and opposite end edges and that is folded in half lengthwise with the outer edges joined to form a lengthwise seam in the sleeve and the end edges joined to form a transverse seam in the sleeve, said sleeve having a predetermined circumferential length approximately equal to the length of the rectangular piece of cloth and a predetermined width that is approximately one-half the width of the rectangular piece of cloth;

stitching threaded through the sleeve circumferentially thereof dividing the sleeve into an annular center pocket between a pair of annular outside pockets, said outside pockets having outside edges; and an elongated band of elastic having a circumferential length when fully stretched approximately equal to or slightly less than the circumferential length of the sleeve, said elastic band being slideably received in the center pocket in concentric relation to the sleeve whereby with the band fully contracted, the sleeve is gathered by the elastic to form closely bunched wrinkles lengthwise of the center pocket and to form more widely spaced undulations in the outside pockets that are of irregular shapes with adjacent peaks of the undulations being spaced farther from each other than adjacent wrinkles in the center pocket, with said undulations extending outwardly from the center pocket in a plurality of directions both toward and away from the axis of the sleeve and axially thereof, and with the outside edges of the outside pockets winding in a spiral pattern circumferentially throughout at least a portion of the sleeve.

* * * * *